US008628455B2

(12) United States Patent
Hsu

(10) Patent No.: US 8,628,455 B2
(45) Date of Patent: Jan. 14, 2014

(54) IDLER ADJUSTING APPARATUS OF EXERCISE MACHINE

(75) Inventor: Ching-Lu Hsu, Taipei (TW)

(73) Assignee: Gee Hoo Fitec Corp., Taipei (TW)

( * ) Notice: Subject to any disclaimer, the term of this patent is extended or adjusted under 35 U.S.C. 154(b) by 468 days.

(21) Appl. No.: 12/985,149

(22) Filed: Jan. 5, 2011

(65) Prior Publication Data

US 2012/0172181 A1 Jul. 5, 2012

(51) Int. Cl.
*A63B 22/06* (2006.01)
*A63B 21/00* (2006.01)

(52) U.S. Cl.
USPC ..... 482/57; 482/63

(58) Field of Classification Search
USPC ..... 482/57–65
See application file for complete search history.

(56) References Cited

U.S. PATENT DOCUMENTS

| | | | | | |
|---|---|---|---|---|---|
| 3,599,411 | A * | 8/1971 | Scarnato et al. | 56/228 |
| 3,603,249 | A * | 9/1971 | Mumma et al. | 101/35 |
| 3,633,345 | A * | 1/1972 | Scarnato et al. | 56/14.1 |
| 3,722,277 | A * | 3/1973 | Fell et al. | 474/5 |
| 3,749,202 | A * | 7/1973 | Puls | 187/201 |
| 3,840,082 | A * | 10/1974 | Olson | 180/9.5 |
| 3,965,768 | A * | 6/1976 | Foster | 474/2 |
| 4,770,411 | A * | 9/1988 | Armstrong et al. | 482/64 |
| 4,932,650 | A * | 6/1990 | Bingham et al. | 482/59 |
| 5,114,391 | A * | 5/1992 | Pitzen et al. | |
| 5,542,893 | A * | 8/1996 | Petersen et al. | 482/72 |
| 5,643,146 | A * | 7/1997 | Stark et al. | 482/63 |
| 5,795,270 | A * | 8/1998 | Woods et al. | 482/72 |
| 5,928,097 | A * | 7/1999 | Mast | 474/133 |
| 6,142,862 | A * | 11/2000 | Dalgord et al. | 452/137 |
| 6,234,939 | B1 * | 5/2001 | Moser et al. | 482/63 |
| 6,361,479 | B1 * | 3/2002 | Hildebrandt et al. | 482/72 |
| 6,551,219 | B1 * | 4/2003 | Brown | 482/57 |
| 6,666,799 | B2 * | 12/2003 | Hildebrandt et al. | 482/57 |
| 6,772,969 | B2 * | 8/2004 | Tokui et al. | 241/101.2 |
| 6,790,162 | B1 * | 9/2004 | Ellis et al. | 482/51 |
| 6,932,745 | B1 * | 8/2005 | Ellis | 482/52 |
| 7,029,424 | B2 * | 4/2006 | Chen | 482/63 |
| 7,445,584 | B2 * | 11/2008 | Wu | 482/57 |
| 8,147,388 | B2 * | 4/2012 | Bingham et al. | 482/57 |
| 2011/0082014 | A1 * | 4/2011 | Leonhard | 482/57 |

* cited by examiner

*Primary Examiner* — Stephen Crow
(74) *Attorney, Agent, or Firm* — Tracy M. Heims; Apex Juris, pllc

(57) ABSTRACT

An exercise machine includes a machine base, on which an axle, a small pulley on the axle, a big pulley, a belt running around the small pulley and the big pulley, at least an idler, and an idler adjusting apparatus are provided. The idler adjusting apparatus includes a lever, on which the idler is pivoted, a linkage connected to the lever, and an adjusting device connected to the linkage. The adjusting device having a bolt head sticking out of the machine base that user may work with the bolt head directly to adjust the idler, without having to disassemble any part of the exercise machine.

8 Claims, 5 Drawing Sheets

IDLER ADJUSTING APPARATUS OF EXERCISE MACHINE

BACKGROUND OF THE INVENTION

1. Field of the Invention

The present invention relates generally to an exercise machine, and more particularly, to an idler adjusting apparatus of an exercise machine.

2. Description of the Related Art

A conventional exercise machines, such as stationary bikes, elliptical trainer and other training machines, usually is provided with a flywheel therein. User who works out on such exercise machine, turns the flywheel through a crank and a belt. Flywheel is an energy storage device that provides user a stable exercise condition.

Typically, an idler is provided between the crank and the flywheel to press the belt that, the belt may keep a predetermined tension for transmission. It only needs one idler when the crank only transmit power in one direction, but it needs two idlers when the crank transmits power in both directions.

After the machine has been running for some time, the belt will become loose due to material fatigue or other reasons. The idler is adjustable in some machines; i.e. tension of the belt can be adjusted. However the case of the machine needs to be disassembled, or has to be taken apart in order to allow some parts of the machine to find the adjusting device. It is a hard job for an ordinary user to do it alone at home. He/she usually needs to call a professional technician for help.

SUMMARY OF THE INVENTION

The primary objective of the present invention is to provide an idler adjusting apparatus of an exercise machine, which provides an easy way for user to adjust the idler at home.

According to the objective of the present invention, an exercise machine includes a machine base, on which an axle, a small pulley on the axle, a big pulley, and a belt running around the small pulley and the big pulley. An idler, and an idler adjusting apparatus are provided. The idler adjusting apparatus is connected to the idler to move the idler, and the idler adjusting apparatus includes an adjusting device, having a portion sticking out of the machine base, so it is apparent to the eye.

Therefore, user may work with the adjusting device directly, to adjust the idler without having to disassemble any part of the exercise machine.

DETAILED DESCRIPTION OF THE INVENTION

Figure 1:
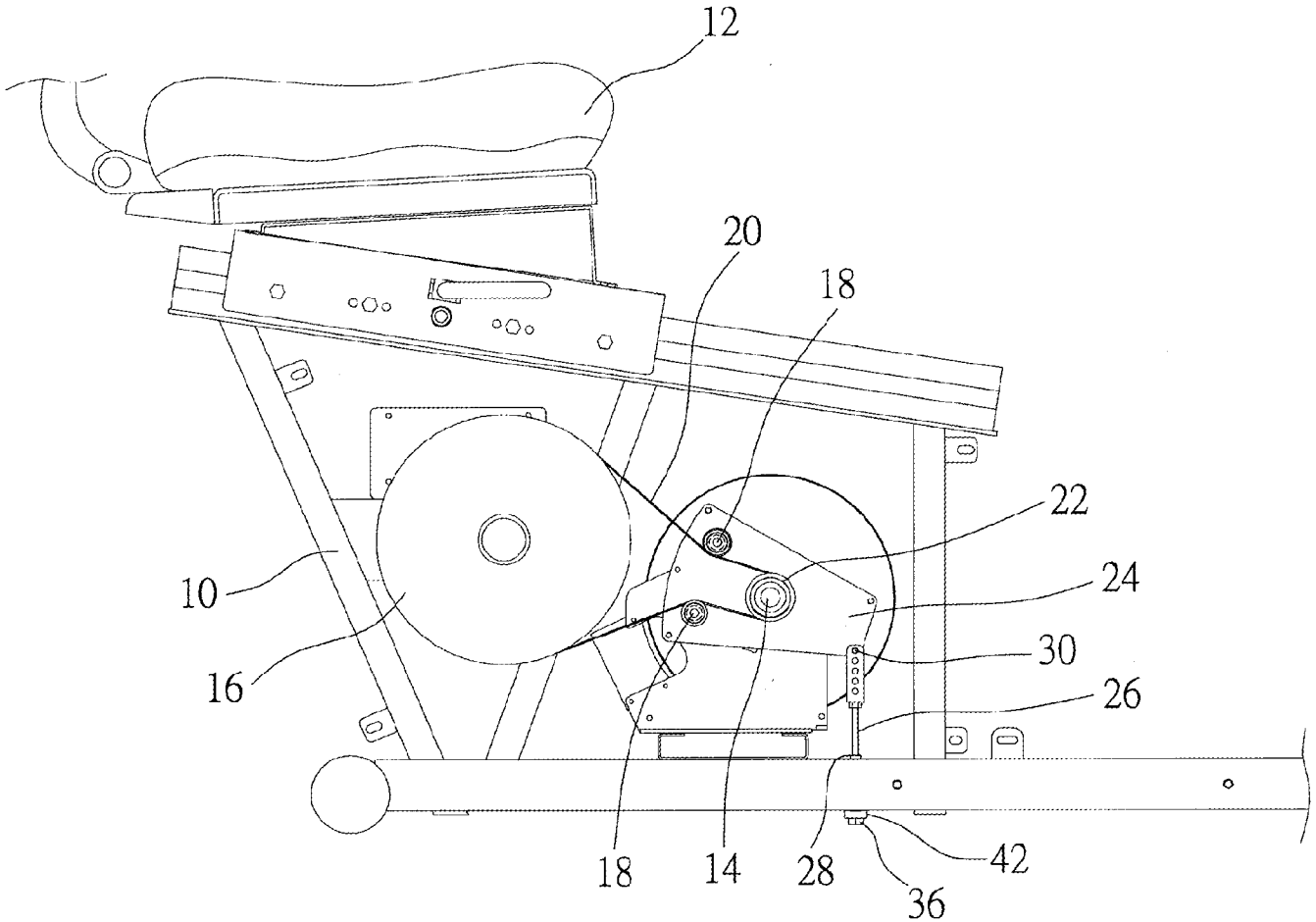
FIG. 1 is a front view of a preferred embodiment of the present invention.

As shown in FIG. 1, an exercise machine of the preferred embodiment of the present invention includes a machine base

10, on which a seat 12, an axle 14, a big pulley 16, two idlers 18, and a belt 20 are provided. The axle 14 is provided with a small pulley 22. The belt 20 runs around the small pulley 22 and the big pulley 16, and the idlers 18 presses the belt 20, to allow the belt 20 maintaining just the right amount of tension. There are some other components in the machine, such as case covering the machine base 10, a pair of cranks connected to the axle 14, controller, and other devices mounted in a conventional exercise machine, not shown in drawings. These missing components are not the main specification of the present invention, so we do not describe them in detail here.

The present invention provides an idler adjusting apparatus, including a lever 24, a linkage, and an adjusting device 28.

Figure 2:
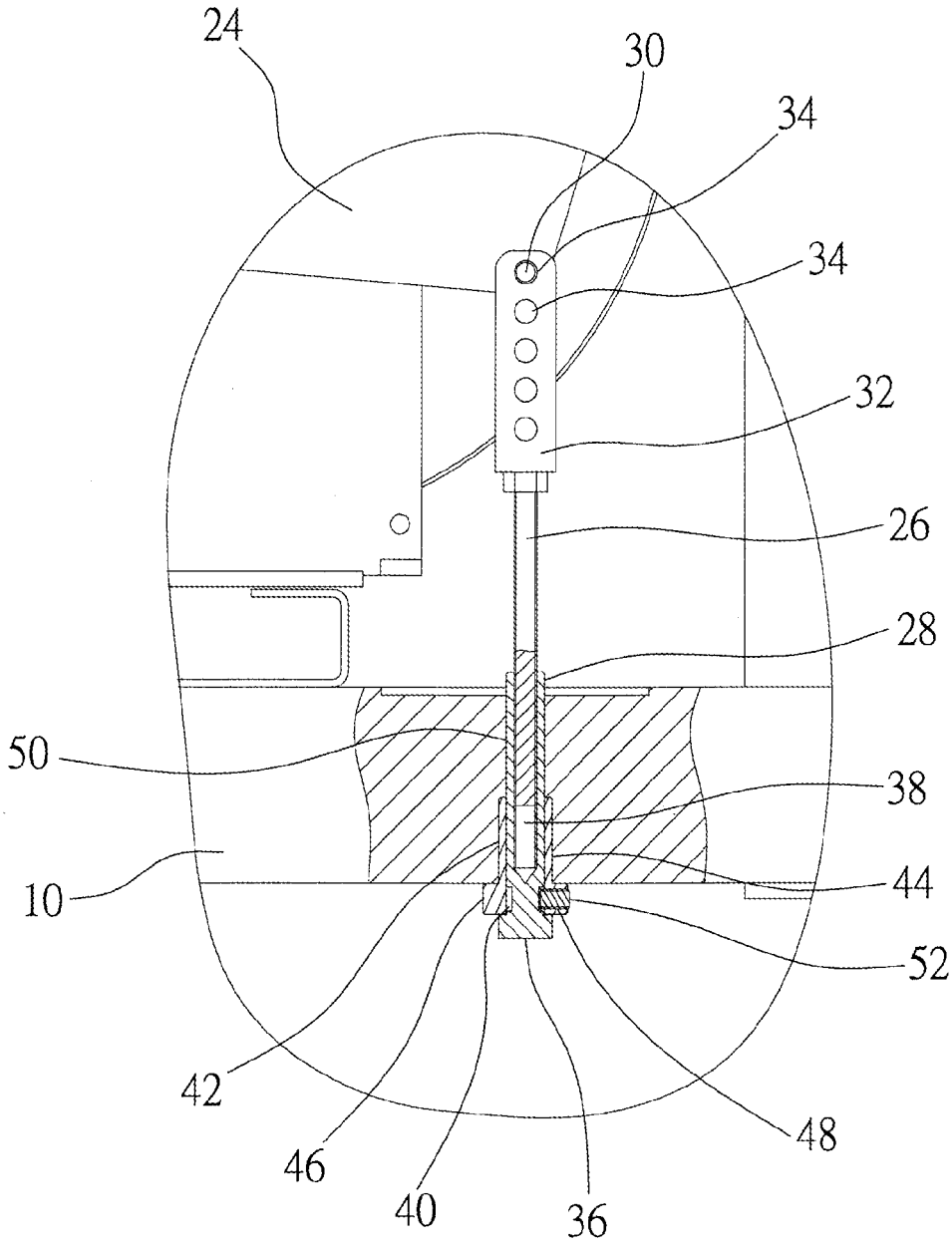
FIG. 2 is an enlarged view of the adjusting device, the hub and the linkage of the preferred embodiment of the present invention.

The lever 24 is a plate, on which the idlers 24 are pivoted. The lever 24 has an opening for the axle 14, passing therethrough that the lever 24 is pivoted on the machine base 10, to be rotated relative to the axle 14. The lever 24 has a pin 30 at a lower right corner thereof. In other words, a center of rotation of the lever 24, the axle 14, is between the idlers 18, and the pin 30. As shown in FIG. 2, the linkage 26 has a threaded section and a flat portion 32 at an end thereof, on which a plurality of apertures 34 are provided. The pin 30 of the lever 24, may be engaged with any one of aperture 34 on the linkage 26, with the flat portion 32 rested on the lever 24. The adjusting device 28 has a hexagonal bolt head 36 at an end thereof, and a threaded hole 38 at the other end thereof. The adjusting device 28 further has a slot behind the bolt head 36. A hub 42 has a hallow section, through hole 44 at a center thereof, which a diameter thereof, is greater than the adjusting device 28. The hub 42 has a flange 46 at an end thereof. The flange 46 has an opening 48 through the through hole 44. The machine base 10 is provided with a bore 50, which is a two-order hole with a bigger lower end. The hub 42 is inserted into the bore 50 via the lower end in interference fitness and the flange 46 is rested on the bottom of the machine base 10. The adjusting device 28 is inserted into the bore 50 of the machine base 10 via the through hole 44 of the hub 42, and the bolt head 36 is left sticking out of the hub 42. A pin 52 is inserted into the opening 48 on the flange 46 of the hub; it enters the slot 40 of the adjusting device 28 that, the adjust device 29 is fixed in the bore 50 of the machine base 10 for free rotation. The linkage 26 is screwed into the threaded hole 38 of the adjusting device 28.

Figure 3:
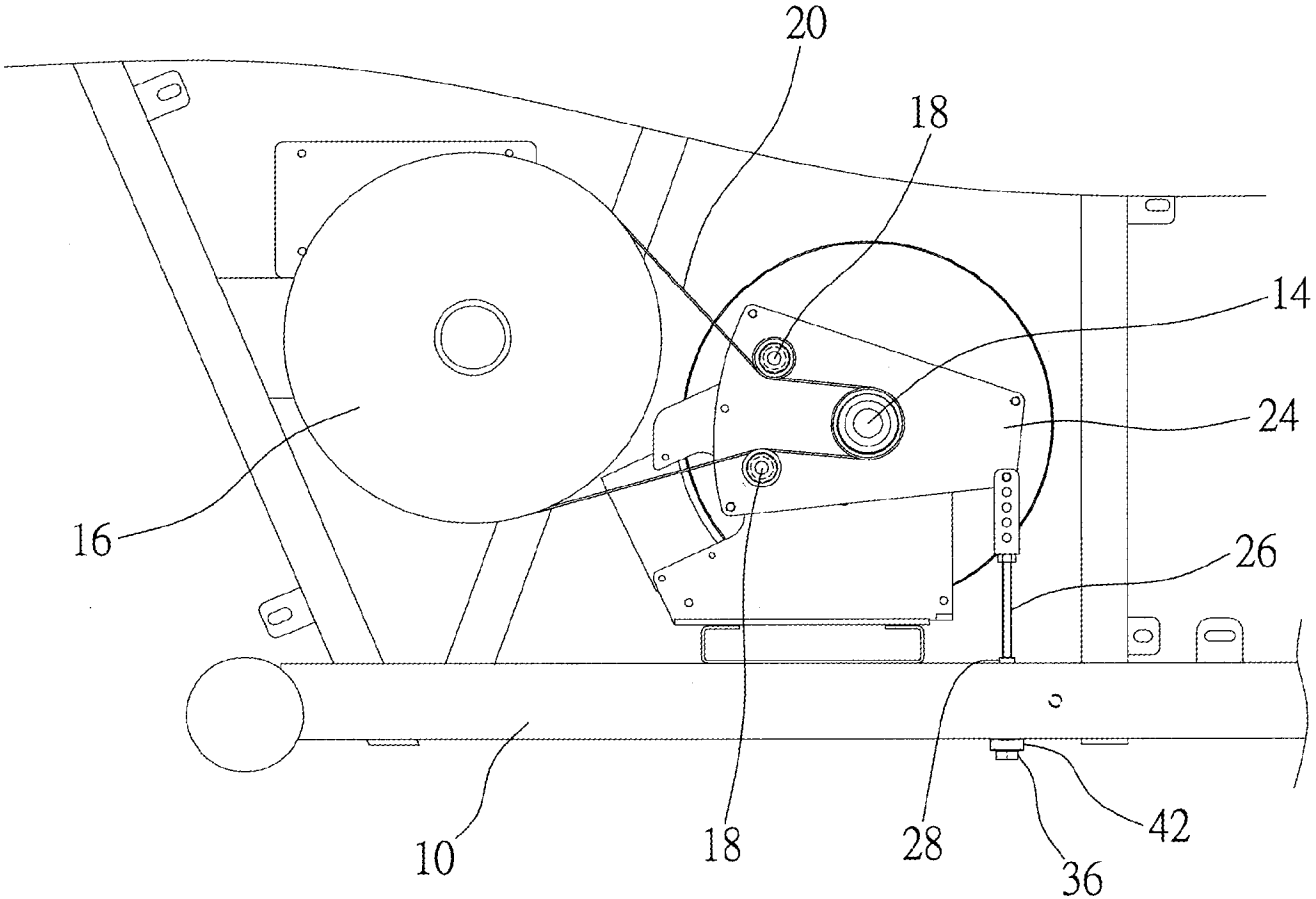
FIG. 3 is a front view of the preferred embodiment of the present invention, showing the bolt head being turned to adjust the lever.
Figure 4:
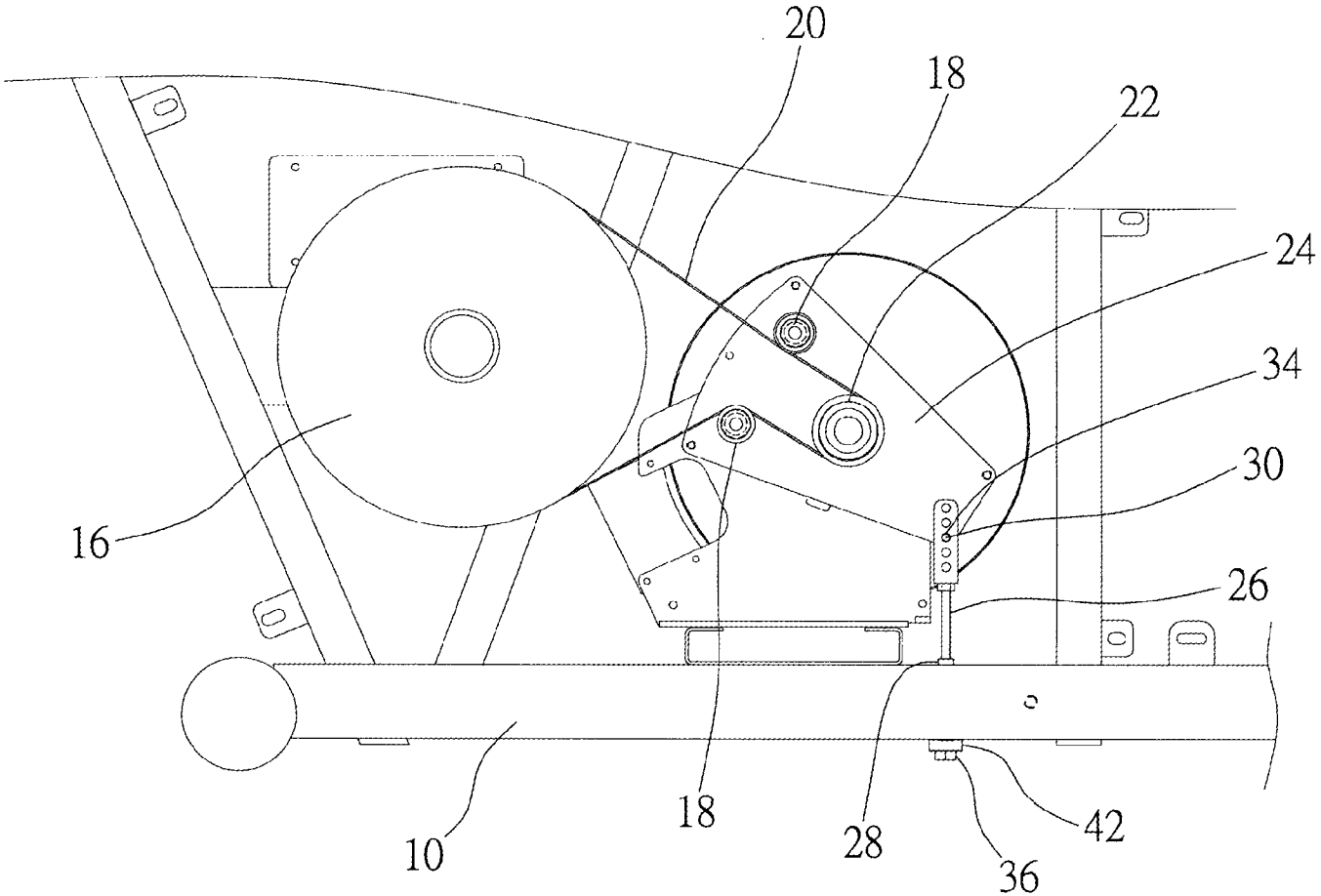
FIG. 4 is a front view of the preferred embodiment of the present invention, showing the pin of the lever connected to the third aperture of the linkage.

When user turns the bolt head 36 of the adjusting device 28, it will move the linkage 26 into the threaded hole 38, or out of the threaded hole 38 to rotate the lever 24. As shown in FIG. 3, when the bolt head 36 of the adjusting device 28 is turned to move the linkage 26, and the right side of the lever 24 upward, it will rotate the lever 24 in counter-clock position for an angle. At the same time, the idlers 18 on the lever 24 are moved in the same direction to change the pressures of the idlers 18 on the belt 20, for adjustment of the tension of the belt 20.

Figure 5:
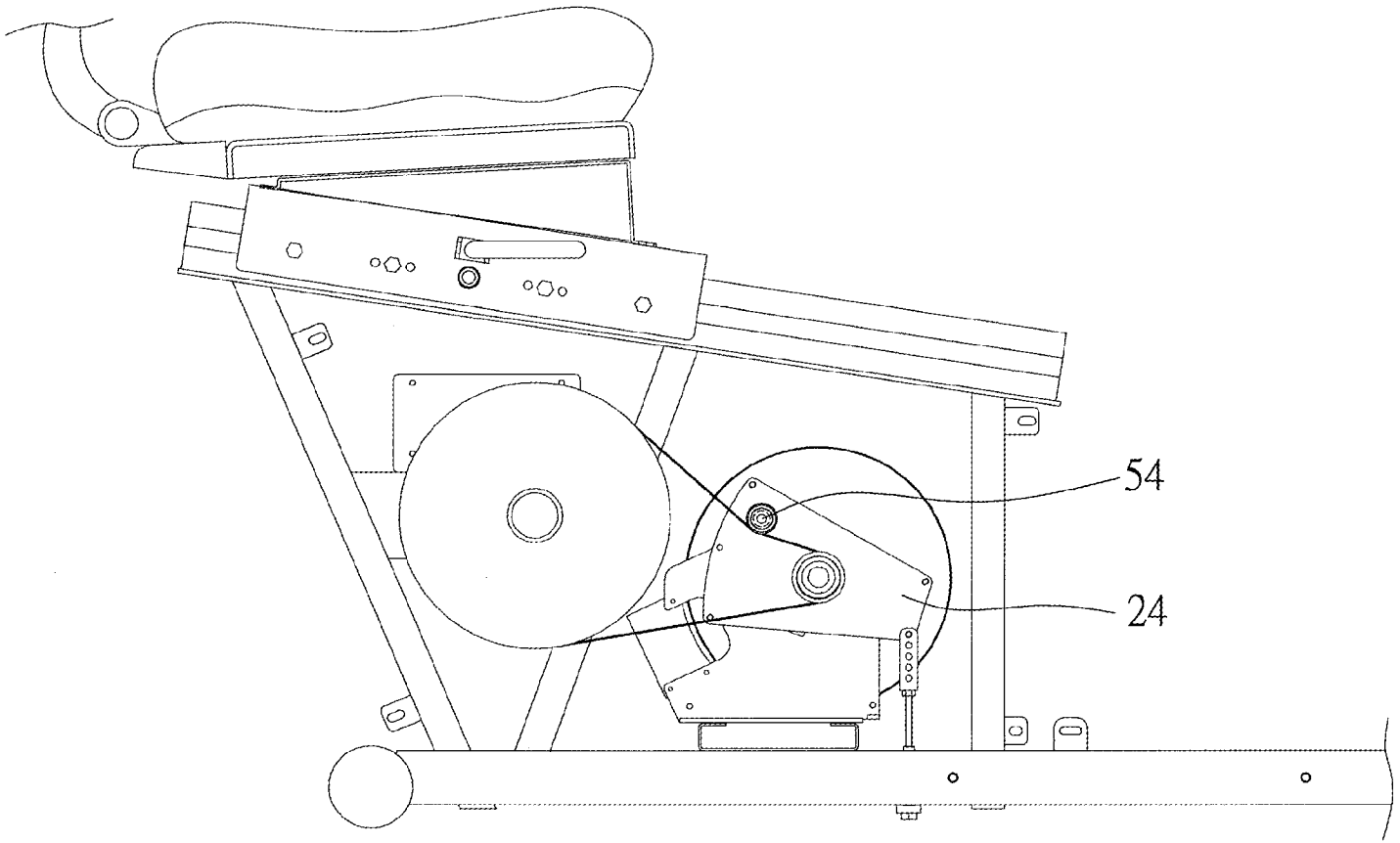
FIG. 5 is a front view of the single idle adjusting apparatus of another preferred embodiment of the present invention.

FIG. 5 shows an exercise machine having only one idler 54 on the lever 24, and the rest of the components of the adjusting apparatus, are identical to what was mentioned above. In other words, the adjusting apparatus may be applied to the exercise machine with single idler.

The description above is a few preferred embodiments of the present invention, and the equivalence of the present invention is still in the scope of claim construction of the present invention.

What is claimed is:

1. An exercise machine comprising:

a machine base, on which an axle, a pair of cranks connected to the axle, a small pulley on the axle, a big pulley, a belt running around the small pulley and the big pulley, at least an idler, and an idler adjusting apparatus are provided, wherein the idler adjusting apparatus is connected to the idler to move the idler, and the idler adjusting apparatus includes an adjusting device having a portion sticking out of the machine base, wherein the adjusting apparatus further includes a lever pivoted on the machine base, and the idler is pivoted on the lever.

2. The exercise machine as defined in claim 1, wherein the lever has an opening to be fitted to the axle.

3. The exercise machine as defined in claim 1, wherein the adjusting apparatus further includes a linkage having an end connected to the lever, and the adjusting device has a threaded hole and the linkage has a threaded section to be screwed into the threaded hole of the adjusting device.

4. The exercise machine as defined in claim 3, wherein the lever has a pin, and the linkage has a plurality of apertures that the pin is inserted into any one of the apertures to connect the linkage to the lever.

5. The exercise machine as defined in claim 4, wherein the linkage has a flat portion, on which the apertures are provided.

6. An exercise machine comprising a machine base, on which an axle, a pair of cranks connected to the axle, a small pulley on the axle, a big pulley, a belt running around the small pulley and the big pulley, at least an idler, and an idler adjusting apparatus are provided, wherein the idler adjusting apparatus is connected to the idler to move the idler, and the idler adjusting apparatus includes an adjusting device having a portion sticking out of the machine base, wherein the machine base has a bore that the adjusting device passes through, and the adjusting device has a bolt head sticking out of the bore.

7. The exercise machine as defined in claim 6, wherein the idler adjusting apparatus further comprises a hub fixed in the bore of the machine base, wherein the hub has a through hole for the adjusting passing therethrough.

8. The exercise machine as defined in claim 7, wherein the hub has an opening and the adjusting device has a slot that, a pin is inserted into the opening of the hub and enters the slot of the adjusting device.

* * * * *